US006606475B1

(12) United States Patent
Maier et al.

(10) Patent No.: US 6,606,475 B1
(45) Date of Patent: Aug. 12, 2003

(54) DEVICE FOR TRANSFERRING A TONER IMAGE FROM A TONER SUPPORT TAPE TO A TONER MATERIAL WHILE MAINTAINING A CONSTANT TAPE TENSION

(75) Inventors: Stefan Maier, Pliening (DE); Edmund Creutzmann, Schwaben (DE); Joachim Samweber, Eichenau (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/936,099

(22) PCT Filed: Mar. 10, 2000

(86) PCT No.: PCT/EP00/02136

§ 371 (c)(1),
(2), (4) Date: Jan. 29, 2002

(87) PCT Pub. No.: WO00/54266

PCT Pub. Date: Sep. 14, 2000

(30) Foreign Application Priority Data

Mar. 10, 1999 (DE) ..... 199 10 613

(51) Int. Cl.[7] ..... G03G 15/01; G03G 15/16
(52) U.S. Cl. ..... 399/302; 399/308
(58) Field of Search ..... 399/66, 101, 162, 399/297, 298, 299, 302, 303, 308, 345

(56) References Cited

U.S. PATENT DOCUMENTS

| | | | | |
|---|---|---|---|---|
| 5,258,816 A | * | 11/1993 | Haneda et al. | 399/345 X |
| 5,291,252 A | * | 3/1994 | Kawaishi | 399/308 X |
| 5,701,566 A | * | 12/1997 | Bisaiji et al. | 399/302 |
| 5,797,077 A | * | 8/1998 | Samizo et al. | 399/302 X |
| 5,828,934 A | | 10/1998 | Tamura et al. | 399/228 |
| 5,983,062 A | * | 11/1999 | Sameshima | 399/302 |
| 6,055,396 A | * | 4/2000 | Pang | 399/162 X |

FOREIGN PATENT DOCUMENTS

| | | |
|---|---|---|
| DE | 41 39 409 A1 | 6/1992 |
| DE | 42 10 077 A1 | 10/1992 |
| EP | 0 686 890 A2 | 12/1995 |
| WO | WO 98/39691 | 9/1998 |

OTHER PUBLICATIONS

Japanese Abstract, Publication No. 10010889 A, Publication Date: Jan. 16, 1998, "Image Forming Device".

* cited by examiner

*Primary Examiner*—Sandra Brase
(74) *Attorney, Agent, or Firm*—Schiff Hardin & Waite

(57) ABSTRACT

A printer or copier has a toner transfer belt which is moved into an out of engagement with a transfer printing area. The toner transfer belt is carried on an arrangement of rollers that maintain a constant tension on the toner transfer belt. Rigid linking levers extend between the rollers of the roller arrangement so that belt tension is maintained by movement of compensation rollers, outward while moving a transfer roller upward, for example.

14 Claims, 5 Drawing Sheets

DEVICE FOR TRANSFERRING A TONER IMAGE FROM A TONER SUPPORT TAPE TO A TONER MATERIAL WHILE MAINTAINING A CONSTANT TAPE TENSION

BACKGROUND OF THE INVENTION

1. Field of the Invention

The present invention relates to a device for transferring at least one toner image from a toner carrier belt onto a carrier material, whereby the toner carrier belt carries the toner image to be transferred and has a predetermined belt tension, and whereby the toner carrier belt, in a first operating status, is arranged close to the carrier material in the transfer area in order to transfer the toner image and, in a second operating status, is arranged at a predetermined distance from the carrier material in the transfer area in order to prevent a transfer of the toner image.

2. Description of the Related Art

Published PCT Application No. WO 98/39691 of the same applicant discloses a printer or copier for the performance-adapted monochromous printing and/or colored one-sided or two-sided printing of a recording medium. The device uses a transfer belt onto which toner images of different hues are superimposed onto one another in a first operating status. The overall toner image arising in this way by superimposition is subsequently transferred to the recording medium. In the collecting operating phase, the toner carrier belt is distanced from the carrier material so that a transfer of the sub-toner images is prevented. The transfer belt is arranged close to the recording medium when the collected overall toner image is transferred for transferring the overall toner image. The content of Published Application WO 98/39691, therefore, is incorporated by reference into the present patent application as disclosure content.

In the aforementioned device concept, the transfer belt therefore is removed from the carrier material at the transfer location given a stoppage of the printing operation and is moved again toward the carrier material when the printing continues. This back and forth motion must be smooth given the operating mode for multicolor printing, in particular, since a transfer printing process occurring at the same time between a photoconductor belt and the transfer belt for transferring a toner image is otherwise impaired—the toner image is blurred, for example. Traditional devices with belt tension devices are not without jerky movements in the toner carrier belt, however, so that belt tension changes lead to a lower printing quality.

German Patent A 42 10 077 discloses an image generation device having an electrostatic transfer device for a latent print image. A roller that can be pivoted via a mechanism serves the purpose of optionally causing contact between a transfer belt and a photoconductor drum.

German Patent A 41 39 409 describes a further image generation device having an electrostatic transfer printing device. A transport belt led via at least two rollers guides a print medium along a photoconductor drum. A latent print image thereby is transferred from the photoconductor drum onto the print medium.

SUMMARY OF THE INVENTION

An object of the present invention is to provide a device for transferring at least one toner image from a toner carrier belt onto a carrier material, whereby a high printing quality is obtained even given a back and forth motion of the toner carrier belt in the transfer printing area.

This object is achieved by a device for transferring at least one toner image from a toner carrier belt onto a carrier material, wherein the toner carrier belt carries the toner image to be transferred and has a predetermined belt tension, the toner carrier belt is held by a belt drive guiding the toner carrier belt through a roller device in the transfer printing area in which the toner image is transfer-printed onto the carrier material, the toner carrier belt, in a first state, is arranged close to the carrier material in the transfer printing area in order to transfer the toner image and, in a second state, is arranged at a predetermined distance from the carrier material in the transfer printing area in order to prevent a transfer of a toner image, and wherein the belt tension in the toner carrier belt is essentially the same in the first and second operating state.

Further advantages of the invention are realized by the belt tension also being the same in the transitional phase from the first operating state to the second operating state. In a preferred embodiment, the roller device is moved back and forth at least approximately perpendicular relative to the carrier material given a change of the operating states.

Preferably, the roller device has one single transfer printing roller which is moved back and forth at least approximately perpendicular given a change of the operating states, the belt drive has a stationary roller with a stationary rotational axis at both sides of the transfer printing roller, a movable compensation roller is respectively arranged between the stationary roller and the transfer printing roller, the respective distance between the rotational axes of the transfer printing roller and the compensation roller and the respective distance between the rotational axes of the compensation roller and the stationary roller remains constant in every operating state, and the diameters of the transfer printing roller, the compensation rollers and of the stationary rollers are of the same size. Specifically, the centers of the rotational axes of the transfer printing roller and the compensation rollers, as well as the centers of the rotational axes of the compensation rollers and the stationary rollers are connected to one another by rigid connecting-rod levers. The surface areas of the stationary rollers and of the compensation rollers may have contact with the toner carrier belt in both operating states and in the transitional phases. A movable cleaning roller of equal diameter may be arranged between the transfer printing roller and at least one of the compensation rollers, and the distance between the rotational axes of the transfer printing roller and of the cleaning roller, as well as the distance between the rotational axes of the cleaning roller and of the compensation roller remains constant in every operating state. The centers of the rotational axes of the transfer printing roller and of the cleaning roller, as well as the rotational axes of the cleaning roller and of the compensation roller are connected by rigid coupling elements.

As a preferred development, the rotational axis of the transfer printing roller is connected to a driving device which, in a linear motion, moves the rotational axis back and forth in an approximately perpendicular manner relative to the carrier material. The driving device may contain a switching eccentric. Alternatively, the rotational axis of the cleaning roller is connected to a further driving device moving the cleaning roller back and forth in a linear motion.

The toner carrier belt may be constructed to engage with a cleaning station or be removed from the cleaning station when the cleaning roller is moved back and forth.

The roller device of one embodiment is driven during its back and forth motion by the control surface of a rotating radial cam, at least one compensation roller is moved back and forth during the rotation of the radial cam, and the difference in length of a belt backlash, given the motion of the roller device, is compensated by the motion of the compensation roller. The roller device may contain two transfer printing rollers which are simultaneously moved back and forth by the control surface of a radial cam, each transfer printing roller having one compensation roller allocated to it, which is moved back and forth by the control surface of a radial cam. The transfer printing rollers and the compensation rollers that are respectively allocated to them are driven by the same radial cam. The radial cams are symmetrically rotated in preferred embodiments, or the radial cams can be asymmetrically rotated.

In one embodiment, the roller device can be moved in the direction of a guide bar, two tension rollers are symmetrically arranged relative to the guide bar, whereby the tension rollers are respectively connected by swivel arms to one end of the guide bar and by respectively one connecting rod to a sliding piece, which can be moved back and forth on the guide bar, and the tension rollers are charged with equal forces for pressing against the toner carrier belt.

A spring pressing against the sliding piece can be arranged on the guide bar. The roller device contains two transfer printing rollers that are symmetrically arranged relative to the guide bar. The belt drive may have two stationarily arranged deviation rollers for the toner carrier belt at both sides symmetrically relative to the center line of the guide bar, and the deviation rollers are of equal diameter. The belt drive of the preferred development does not contain additional tension elements apart from the two tension rollers.

In the first and second operating states, the belt tension in the toner carrier belt is inventively kept constant. The length of the toner carrier belt does not change as a result and belt tension spikes are prevented. Given simultaneous transfer printing of a toner image onto the toner carrier belt at a second transfer area, the environmental conditions in this transfer area remain constant and a high printing quality can be obtained as a result of the constant belt tension.

Advantageously, the belt tension in the toner carrier belt also remains the same in the transitional phase from the first operating state to the second operating state and vice versa. This means that the transport motion of the belt can also be maintained during this transitional phase without reducing the quality given simultaneous transfer printing of a toner image onto the toner carrier belt.

A transfer belt is to be preferably provided as a toner carrier belt, whereby a toner image is transferred, in a transfer printing process, from a toner image generation device, such as a photoconductor drum or a photoconductor belt, onto the transfer belt.

BRIEF DESCRIPTION OF THE DRAWINGS

Exemplary embodiments of the invention are subsequently explained on the basis of the drawings. Further advantages and features of the invention are described on the basis of these exemplary embodiments.

DETAILED DESCRIPTION OF THE PREFERRED EMBODIMENTS

Figure 1:
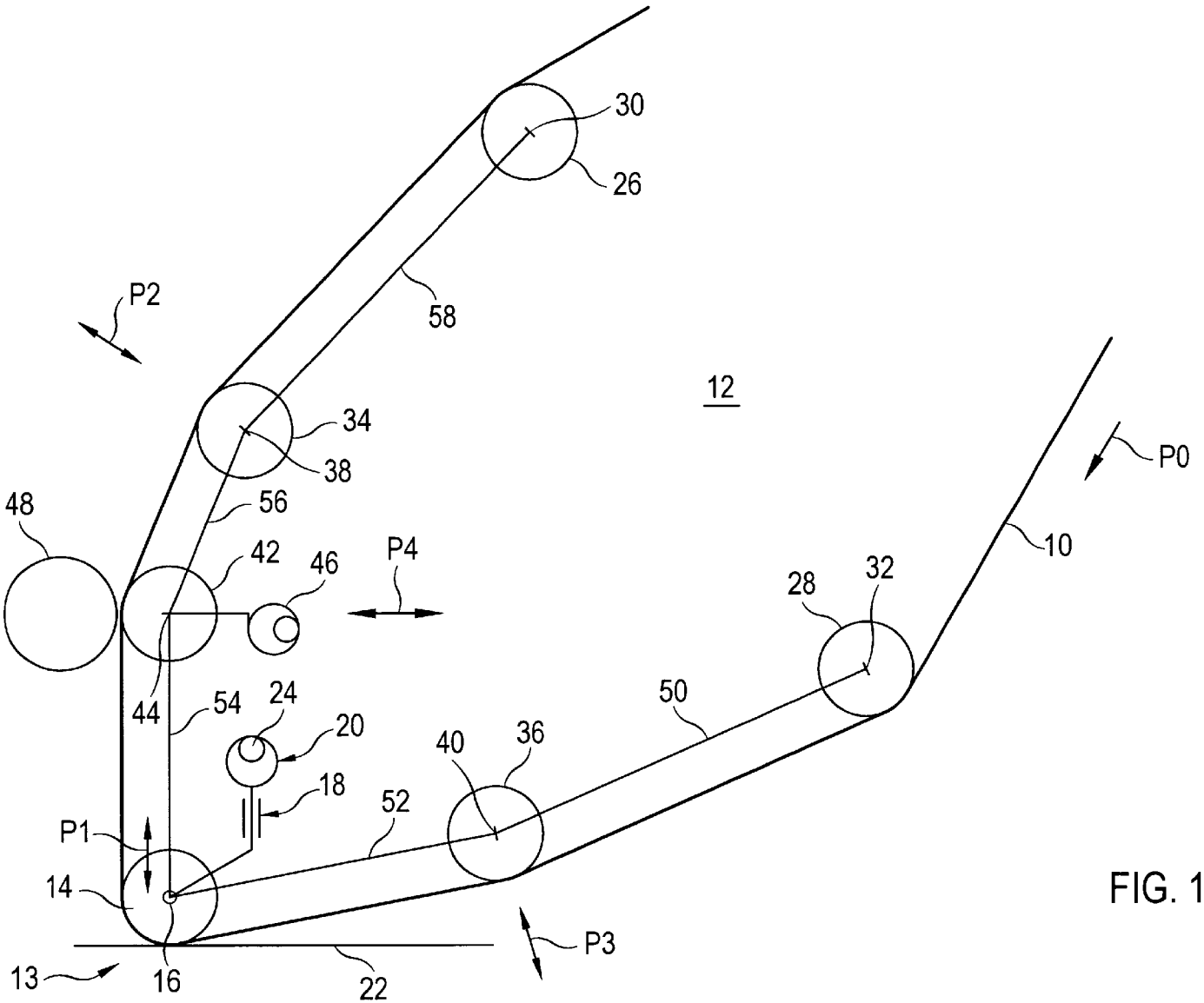
FIG. 1 is a side view which schematically shows a connecting-rod lever movement mechanism.

FIG. 1 shows a first exemplary embodiment of the invention in a simplified schematic representation. A toner carrier belt fashioned as a transfer belt 10 is guided around rollers of a belt drive, which is generally referred to as 12. FIG. 1 only shows one part of the belt drive 12 and of the transfer belt 10. The transfer belt 10 is guided around a roller device 13 with one single transfer printing roller 14, whose rotational axis 16, with the assistance of a longitudinal guide 18 and a driving device, can execute back and forth motions approximately perpendicular relative to a carrier material 22, generally single sheets or belt material composed of paper. The driving device 20 contains a switching eccentric 24, for example, whereby the rotational axis 16 moves back and forth in the direction of the arrow P1 when the switching eccentric is rotated.

The belt drive 12 contains two stationary rollers 26 and 28 whose rotational axes 30 and 32 are stationarily anchored at the frame of the belt drive 12. Compensating rollers 34 and 36, whose rotational axes 38 and 40 are mobile and can be moved in the direction of the arrows P2 and P3, for example, are arranged between the transfer printing roller 16 and the stationary rollers 26 and 28.

A mobile cleaning roller 42, whose rotational axis 44 can be moved back and forth in the direction of the arrow P4 by a further driving device 46 having a switching eccentric, is arranged between the transfer printing roller 14 and the compensating roller 34. During this back and forth motion, the movable cleaning roller 42 with the transfer belt 10 is engaged or disengaged with respect to a cleaning roller 48. This cleaning roller 48 serves the purpose of removing residuary toner material which is still present after the transfer printing on the transfer belt 10.

The rotational axis 32 of the stationary roller 28 and the rotational axis 40 of the movable roller 36 are connected to one another by a rigid coupling element 50, which can execute swivelling motions on the rotational axes 32 and 40. This rigid coupling element 50 serves the purpose of keeping the distance between the rotational axes 32 and 40 in all operating phases constant. A rigid, pivotable coupling element 52 is also arranged between the rotational axis 40 of the movable roller 36 and the rotational axis 16 of the transfer printing roller 14. A further rigid coupling element 54 is provided between the rotational axis 16 of the transfer printing roller 14 and the rotational axis 44 of the cleaning roller 42. The rotational axis 44 of the cleaning roller 42 and the rotational axis 38 of the movable roller 34 are connected via a rigid coupling element 56. Finally, the rotational axis 38 of the movable roller 34 is also connected to the rotational axis 30 of the stationary roller 26 via a rigid, pivotable coupling element 58. The coupling elements 50, 52, 54, 56 and 68 can be of different length. A critical feature of the invention is that the diameter of the rollers 26, 28, 34, 36, 42 and 14 is the same. The rotational axes 16, 30, 32, 38, 40 and 44 are arranged parallel to one another and reside perpendicular relative to the paper plane in FIG. 1.

The transfer belt 10 is generally composed of a plastic material. A slight change in length of the transfer belt 10, e.g. within the mm range, can arise as result of changes in humidity or temperature, for example. For compensating this change in length, a separate tension roller (not shown) can be provided. The roller 28 can also assume the function of a tension roller and can have an excursion of approximately 1 mm. The roller 28, however, can still be considered stationary, since this excursion at the transfer printing location or, respectively, at the transfer printing locations, does not cause a change in location of the toner picture elements to be transferred with respect to the carrier material 22 or a photoconductor belt.

The functions of the arrangement are subsequently explained according to FIG. 1. In the illustrated state of FIG. 1, the transfer belt 10 is kept in immediate proximity of the carrier material 22 given its forward motion in the direction of the arrow P0 or, respectively, is in contact with this carrier material 22. In this operating state, toner images, which are present on the transfer belt 10 in a relatively loose form and have not yet been fixed, can be transfer-printed onto the carrier material 22. Given activation of the driving device 20, a second operating state is adjusted, wherein the transfer printing roller 14 is upwardly moved in the direction of the arrow P1. The motion is transferred, by the coupling elements 50, 52, 54, 56 and 58, onto the movable rollers 34, 36 and 42 when the transfer printing roller 14 is lifted. The stationary rollers 26 and 28 do not move. As it has already been mentioned, the coupling elements 50, 52, 54, 56 and 58 are pivotably borne on the rotational axes 32, 40, 16, 44, 38 and 30. The movable rollers 36, 42 and 34 are predominately moved in the direction of the arrows P2 and P3, since the cleaning roller is stopped and does not execute a movement in the direction of the arrow P4. Since the connecting-rod levers 50, 52, 54, 56 and 58 extend exactly parallel to the corresponding sections of the transfer belt 10, the diameters of the allocated rollers 28, 36, 14, 42, 34 and 26 are identical, a change in length in the transfer belt 10 does not arise, regardless of how large the stroke is by which the transfer printing roller 14 is lifted by the driving device 20. This means that the belt tension in the transfer belt 10 is independent of this stroke and therefore remains constant. A spike or an additional force does not occur when the transfer printing roller 14 moves. Therefore, the belt tension also remains constant in the transitional phase between both operating states of the transfer printing roller 14.

Independently of the motion of the transfer printing roller 14, the driving device 46 can move the cleaning roller 42 back and forth in the direction of the arrow P4. The connecting-rod levers 58, 56 and 54 then perform compensating motions assuring that the transfer belt does not become loose, so that the belt tension therefore also remains the same within the transfer belt 10.

A number of advantages are achieved by the arrangement of FIG. 1. Each time the transfer printing roller 14 moves, the arrangement of the connecting-rod levers 50, 52, 54, 56 and 58 assures an exact allocation of the compensating rollers 36 and 34 to the transfer printing roller 14. Mechanically complicated parts are not necessary; the effective mechanism of the arrangement is clear. The connecting-rod levers 50, 52, 54, 56 and 58 assume the driving and guiding of the compensating rollers 36 and 34. Only the transfer printing roller 14 and the cleaning roller 42 must be moved by a separate drive. The connecting-rod lever movement mechanism makes it possible to include a further swivelling motion of neutral length at a different location of the transfer belt 10, as is shown in the example of the movable cleaning roller 42 which is separately driven by a drive 46.

Figure 2:
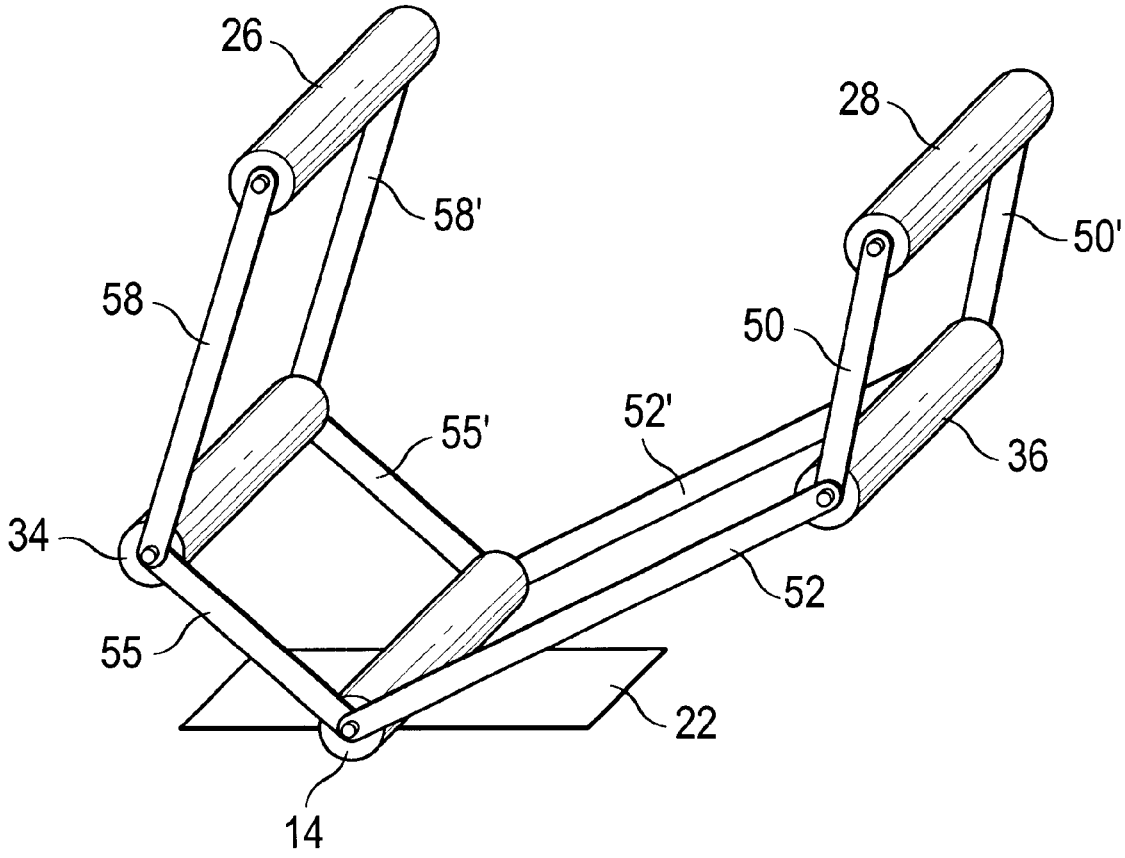
FIG. 2 shows a connecting-rod lever movement mechanism in a simplified perspective representation.

FIG. 2 shows a perspective representation of the movement mechanism of FIG. 1, whereby the same parts are referred to by the same reference character. In the arrangement of FIG. 2, the connecting-rod levers 54 and 56 are combined to one single connecting-rod lever 55. It can be seen in FIG. 2 that connecting-rod levers are arranged on both sides of the rollers. The arrangement in FIG. 2 has corresponding connecting-rod levers 50', 52', 55' and 58' that are arranged in the back.

Figure 3B:
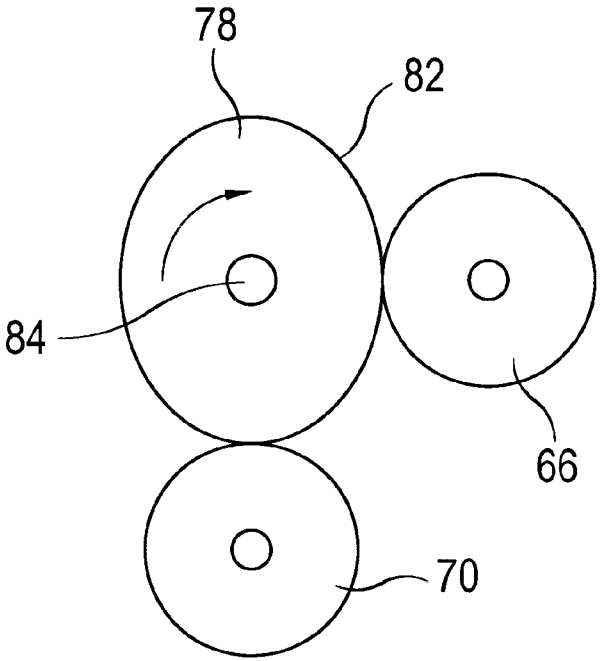
FIGS. 3*a* and 3*b* are schematic side views which show a movement mechanism with radial cams.
Figure 3A:
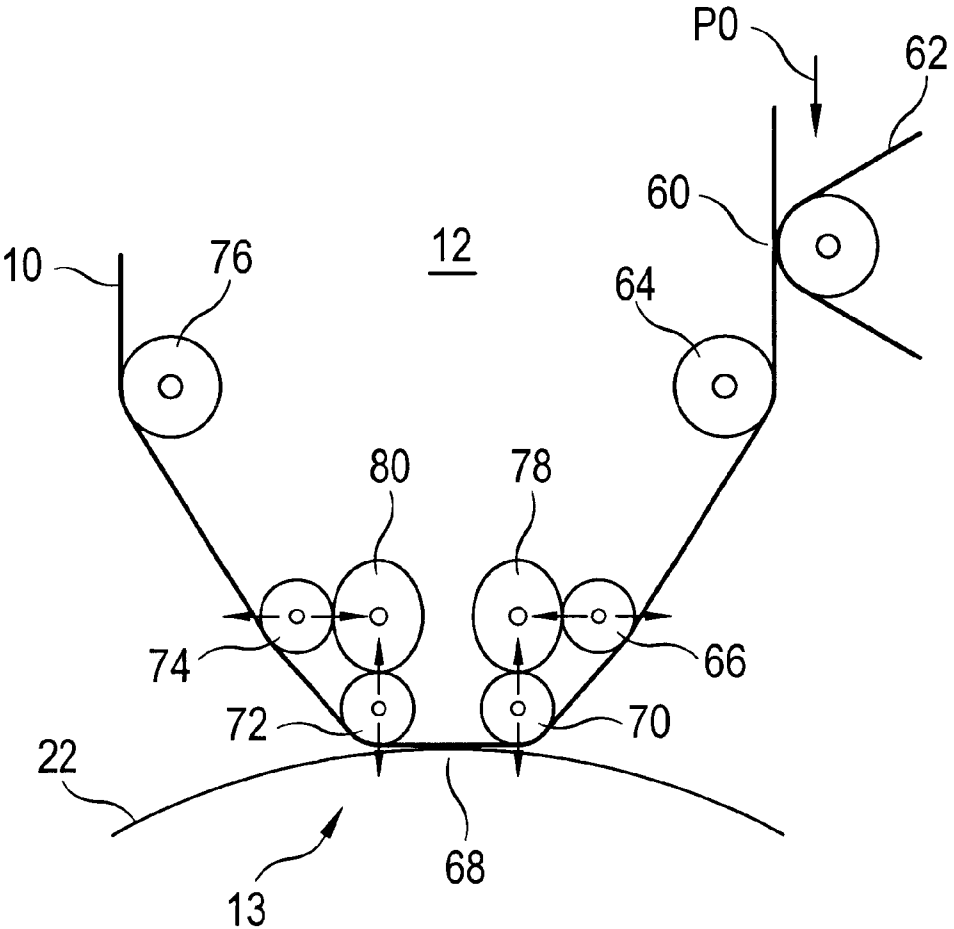

FIGS. 3*a* and 3*b* show another exemplary embodiment, wherein control cams are used. Parts that correspond to previous exemplary embodiments are referred to by the same reference characters. The transfer belt 10 is moved in the direction of the arrow P0 by the belt drive 12. At a first transfer printing location 60, the toner image on a photoconductor belt 62 is transferred onto the transfer belt 10. The transfer belt 10 is deviated at a deviation roller 64 and is guided past a first compensating roller 66, which can be moved in the indicated arrow directions. The transfer belt 10 subsequently arrives at a second transfer printing area 68, in which the toner image situated on the transfer belt 10 or the collected overall color toner image is transferred onto the carrier material 22. The roller device 13, which can be moved back and forth in perpendicular direction relative to the carrier material 22, is arranged in the transfer printing area 68. The roller device 13 has two transfer printing rollers 70 and 72, which can be moved in the direction of the shown arrows. Subsequently, the transfer belt 10 is guided past a second compensating roller 74, which can be moved in the direction of the shown arrows. The belt drive 12 contains a second transfer printing roller 76 at which the transfer belt 10 is deviated.

The deviation rollers 70 and 72 and the compensation rollers 66 and 74 are driven by control cams 78 and 80, as can be seen in greater detail in FIG. 3*b* on the basis of the control cam 78. The control cam 78 has an elliptic control surface 82 and can be rotated around a rotational axis 84. In the shown state, the deviation roller 70 is maximally downwardly excused, whereas the compensation roller 66 is maximally excused to the left. Given a clockwise rotation of the control cam 78, the compensating roller 66, in FIGS. 3*a* and 3*b*, is excused to the right due to the elliptic control surface 82, whereas the deviation roller 70 moves upward given a corresponding pretension. If the compensating roller 66 was stationary, the transfer belt 10 wrapping around the two rollers 66 and 70 would become loose by a difference of length when the transfer printing roller 70 moves upward. The control surface 82 of the control cam 78 is arched such that the difference of length resulting from the upward motion of the transfer printing roller 70 is precisely compensated by the motion of the compensating roller 66 to the right. The resulting control surface 82 must not necessarily be elliptical but can also assume a different cam shape.

Figure 4B:
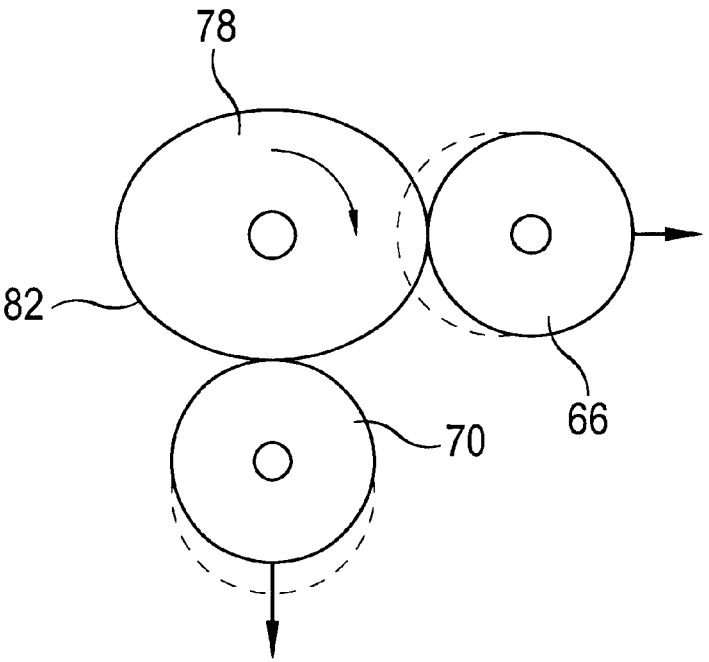
FIGS. 4*a* and 4*b* are schematic side views which show the radial cams according to FIGS. 3*a* and 3*b* in a different movement phase.
Figure 4A:
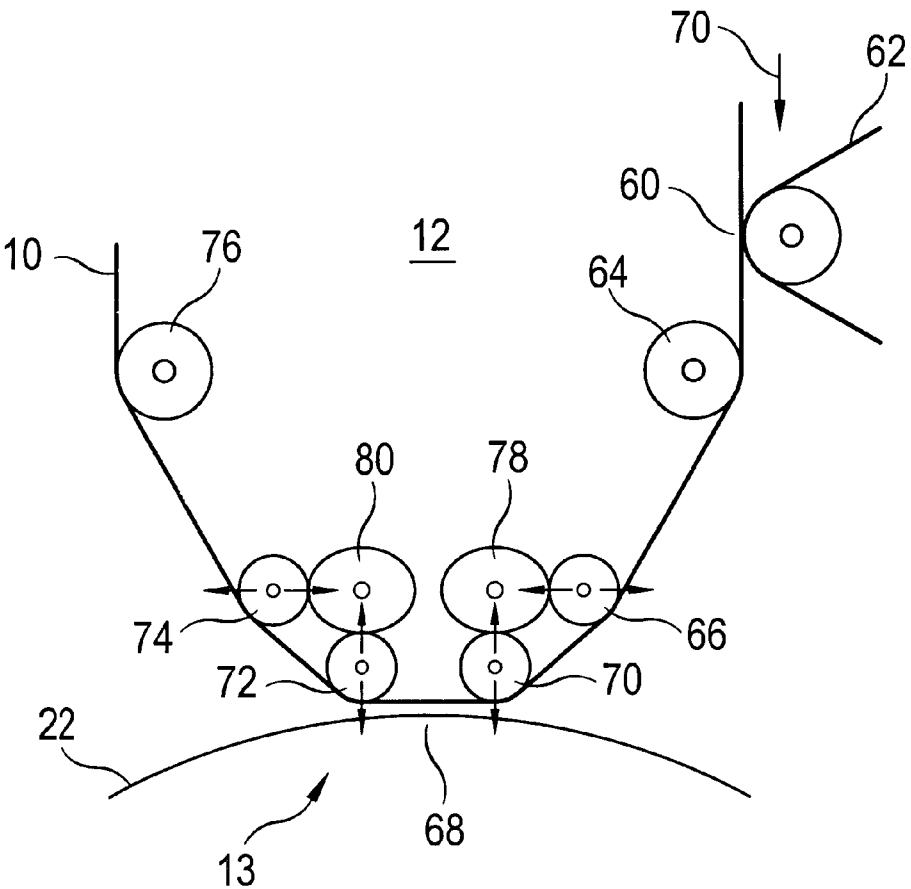

FIGS. 4*a* and 4*b* show the relationships when the radial cams 78 and 80 have rotated by 90° in a clockwise direction. The transfer printing roller 70 and the compensation roller 66 moved from the position which is shown in broken lines in FIG. 4*b* to the position shown with solid lines. It can be seen in FIG. 4*a* that the transfer belt 10 is lifted from the carrier material 22 in the shown state. In this state, a transmission of toner images onto the carrier material 22 is prevented; the transfer belt 10 and the carrier material 22 can have different speeds, whereby this is advantageous for starting the printing operation and for stopping the printing operation, since a relative motion can occur in these operating statuses. The control surface 82 of the radial cam 78 is preferably arched such that a length compensation for the transfer belt 10 ensues such that the difference in length of the transfer belt 10, in the entire motion phase of the deviation rollers 70 and 72 and of the compensation rollers 66 and 74, is compensated as a result of the back and forth motion of the deviation rollers 70 and 72. In this case, belt tension modifications do not arise in the transfer belt 10, so that a transfer printing can continue at the transfer printing location 60 without blur effects.

In the exemplary embodiment according to the FIGS. 3*a*, 3*b*, 4*a* and 4*b*, the two radial cams 78 and 80 are symmetrically rotated, whereby a symmetric motion process also results and the two deviation rollers 70 and 72 are swivelled in a parallel fashion. This exemplary embodiment according to the FIGS. 3*a* to 4*b* can be multiply varied. The radial cams 78 and 80 can be asymmetrically rotated, so that different asymmetrical swivel courses are obtained. For operating the roller pair deviation roller 70 and appertaining compensation roller 66 or, respectively, the roller pair deviation roller 72 and compensation roller 74, a common radial cam 78 or, respectively, 80 or separate radial cams can be arranged on common or separate axes.

Figure 5:
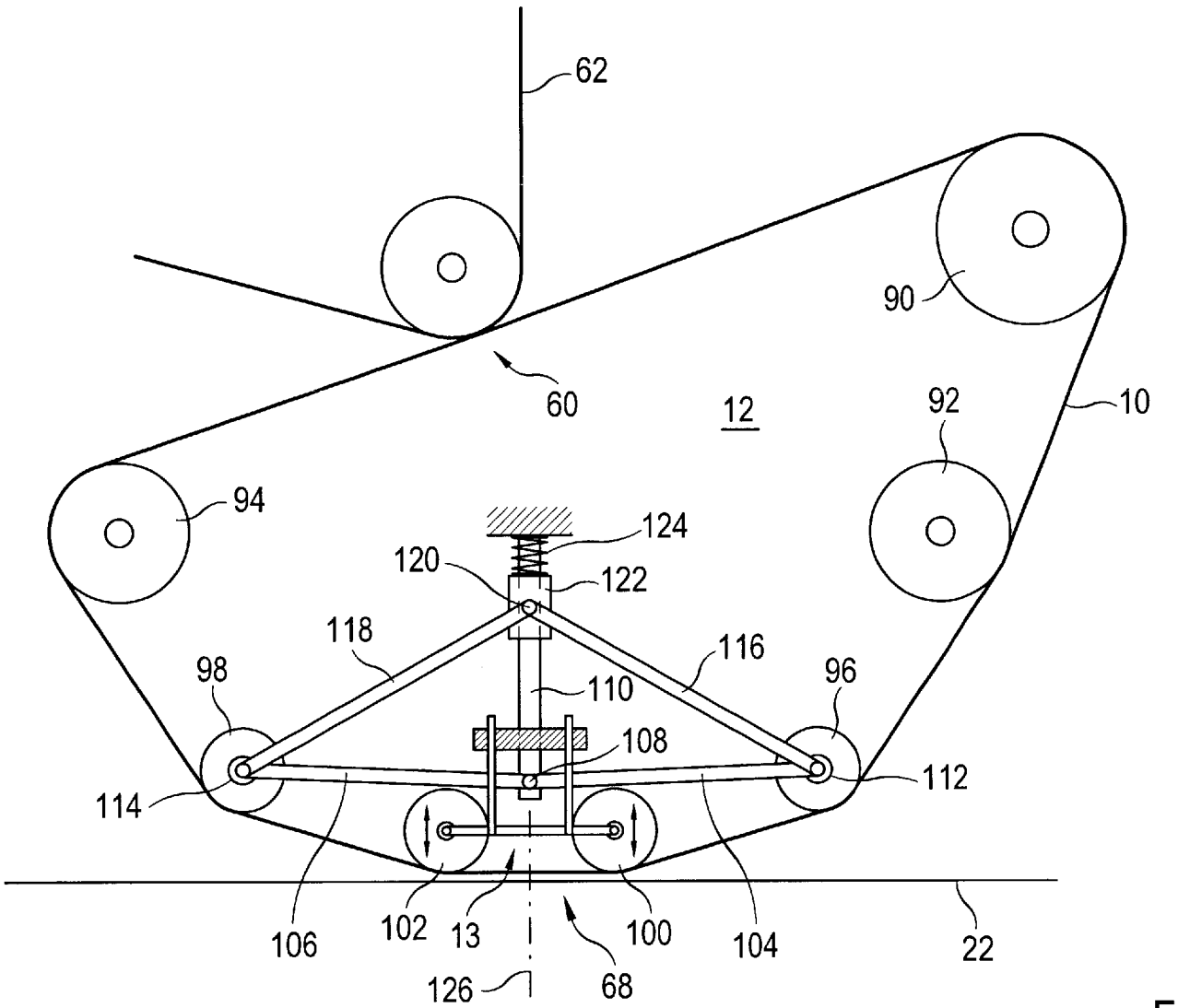
FIG. 5 is a side view which shows a further exemplary embodiment with tension rollers.

FIG. 5 shows a further exemplary embodiment of the invention, wherein spring-loaded tension rollers are used. The belt drive 12 transporting the transfer belt 10 has stationary deviation rollers 90, 92 and 94, two tension rollers 96 and 98 and a roller device 13, which is composed of two transfer printing rollers 100 and 102 and which can be moved back and forth. The tension rollers 96 and 98, by swivel arms 104, 106, are pivotably attached to a rigid rotational axis 108 at the end of a guide bar 110. The rotational axes 112 and 114 of the tension rollers 96 and 98, via connecting rods, are pivotally borne on a pivot 120, which is attached to a sliding piece 122. The sliding piece 122 can be moved along the guide bar 110. The roller device 13 with the two deviation rollers 100 and 102 can also be moved along the guide bar 110. The guide bar is stationarily fastened with respect to the belt drive 12 at the upper end in a rigid manner. A pressure spring 124 generates a pretension onto the sliding piece 122. If the roller device 13 is now upwardly moved along the center line 126, a belt backlash would occur in the transfer belt 10 given stationary belt rollers 96, 98. The pressure spring 124 downwardly pushes the sliding piece 122 along the guide bar 110, whereby the connecting rods 116 and 118 symmetrically move the tension rollers 96 and 98 to the outside along an orbit, which is defined by the swivel arms 104 and 106. It is thus prevented that a belt backlash arises. The transfer belt 10 is equally tensioned on both sides of the roller device 13 as a result of the symmetrical arrangement of the tension rollers 96 and 98, the connection by the connecting rods 116, 118 and the central spring 124. Assuming that the transfer belt does not stretch itself, the actual belt length cannot change. It results therefrom that the individual picture elements on the transfer belt 10 move along the center line 126 and therefore perpendicular to the carrier material 22 at the transfer printing location 68. It is thus ensured that the toner image is not blurred. Given swivelling-to and swivelling-from the roller device 14 onto the carrier material 22, the printing image cannot become blurred. In order to obtain a symmetrical behavior, the two deviation rollers 92 and 94 are to be symmetrically arranged relative to the center line 126. Due to the spring excursion, the belt tension can be slightly different in the printing transfer belt 10 in both operating modes; however, it is assured that the length of the transfer belt remains constant in both operating states with swivelled-to and swivelled-from roller device 13.

Although other modifications and changes may be suggested by those skilled in the art, it is the intention of the inventors to embody within the patent warranted hereon all changes and modifications as reasonably and properly come within the scope of their contribution to the art.

What is claimed is:

1. A device for transferring a toner image onto a carrier material, comprising:

a toner carrier belt which carries the toner image to be transferred and has a predetermined belt tension;

a roller arrangement supporting said toner carrier belt;

a belt drive guiding said toner carrier belt through said roller arrangement in a transfer printing area in which the toner image is transfer-printed onto the carrier material; and apparatus for moving said toner carrier belt between a first state close to the carrier material in the transfer printing area to transfer the toner image and a second state arranged at a predetermined distance from the carrier material in the transfer printing area to prevent a transfer of the toner image, a belt tension in said toner carrier belt being essentially the same in said first state and said second state;

wherein said roller arrangement includes one single transfer printing roller which is moved back and forth at least approximately perpendicular given a change between said first and second states;

said belt drive including a stationary roller with a stationary rotational axis at each of both sides of said transfer printing roller;

said roller arrangement including a movable compensation roller arranged between each of said stationary rollers and said transfer printing roller;

the respective distance between the rotational axes of the transfer printing roller and the compensation roller and the respective distance between the rotational axes of the compensation roller and the stationary roller remains constant in every state; and diameters of the transfer printing roller, the compensation rollers and of the stationary rollers being of the same size.

2. A device as claimed in claim 1, further comprising:

rigid connecting levers connecting centers of the rotational axes of the transfer printing roller and the compensation rollers, as well as the centers of the rotational axes of the compensation rollers and the stationary rollers to one another.

3. A device as claimed in claim 1, wherein surface areas of the stationary rollers and of the compensation rollers have contact with the toner carrier belt in both operating states and in the transitional phases.

4. A device as claimed in claim 1, further comprising:

a movable cleaning roller of substantially equal diameter to said transfer printing roller and said compensation rollers arranged between said transfer printing roller and at least one of said compensation rollers, and a distance between rotational axes of said transfer printing roller and of said cleaning roller, as well as the distance between the rotational axes of the cleaning roller and of the compensation roller remains constant in every operating state.

5. A device as claimed in claim 4, further comprising:

rigid coupling elements connecting centers of the rotational axes of the transfer printing roller and of the cleaning roller, as well as the rotational axes of the cleaning roller and of the compensation roller.

6. A device for transferring-a toner image onto a carrier material, comprising:

a toner carrier belt which carries the toner image to be transferred and has a predetermined belt tension;

a roller arrangement supporting said toner carrier belt;

a belt drive guiding said toner carrier belt through said roller arrangement in a transfer printing area in which the toner image is transfer-printed onto the carrier material; and apparatus for moving said toner carrier belt between a first state close to the carrier material in the transfer printing area to transfer the toner image and a second state arranged at a predetermined distance from the carrier material in the transfer printing area to prevent a transfer of the toner image, a belt tension in said toner carrier belt being essentially the same in said first state and said second state;

a rotating radial cam having a control surface operating to drive the roller device during its back and forth motion; and at least one compensation roller operating to move back and forth during rotation of said radial cam, a difference in length of a belt backlash given motion of the roller device being compensated by motion of the compensation roller;

wherein the roller arrangement includes two transfer printing rollers which are simultaneously moved back and forth by said control surface of said radial cam, each transfer printing roller having one compensation roller allocated to it which is moved back and forth by said control surface of said radial cam.

7. A device as claimed in claim 6, wherein said transfer printing rollers and said compensation rollers that are respectively allocated to them are driven by the same radial cam.

8. A device as claimed in claim 6, wherein said radial cams are symmetrically rotated.

9. A device as claimed in claim 6, wherein said radial cams are asymmetrically rotated.

10. A device for transferring a toner image onto a carrier material, comprising:

a toner carrier belt which carries the toner image to be transferred and has a predetermined belt tension;

a roller arrangement supporting said toner carrier belt;

a belt drive guiding said toner carrier belt through said roller arrangement in a transfer printing area in which the toner image is transfer-printed onto the carrier material; and apparatus for moving said toner carrier belt between a first state close to the carrier material in the transfer printing area to transfer the toner image and a second state arranged at a predetermined distance from the carrier material in the transfer printing area to prevent a transfer of the toner image, a belt tension in said toner carrier belt being essentially the same in said first state and said second state;

a guide bar defining a direction along which said roller arrangement is moved;

a sliding piece which is moved back and forth on said guide bar;

two tension rollers symmetrically arranged relative to said guide bar, said tension rollers being respectively connected by swivel arms to one end of said guide bar and by respectively one connecting rod to said sliding piece, and the tension rollers applying equal pressing forces against said toner carrier belt.

11. A device as claimed in claim 10, further comprising:

a spring pressing against said sliding piece and being disposed on said guide bar.

12. A device as claimed in claim 10, wherein said roller arrangement includes two transfer printing rollers that are symmetrically disposed relative to said guide bar.

13. A device for transferring a toner image onto a carrier material, comprising:

a toner carrier belt which carries the toner image to be transferred and has a predetermined belt tension;

a roller arrangement supporting said toner carrier belt;

a belt drive guiding said toner carrier belt through said roller arrangement in a transfer printing area in which the toner image is transfer-printed onto the carrier material; and apparatus for moving said toner carrier belt between a first state close to the carrier material in the transfer printing area to transfer the toner image and a second state arranged at a predetermined distance from the carrier material in the transfer printing area to prevent a transfer of the toner image, a belt tension in said toner carrier belt being essentially the same in said first state and said second state;

wherein said belt drive has two stationarily arranged deviation rollers for said toner carrier belt at both sides symmetrically relative to a center line of a guide bar, and said deviation rollers are of equal diameter.

14. A device as claimed in claim 10, wherein said belt drive does not contain additional tension elements apart from said two tension rollers.

* * * * *